US010246111B2

(12) United States Patent
Brooks et al.

(10) Patent No.: US 10,246,111 B2
(45) Date of Patent: Apr. 2, 2019

(54) VEHICLE CONTROL SYSTEM

(71) Applicant: General Electric Company, Schenectady, NY (US)

(72) Inventors: James D. Brooks, Schenectady, NY (US); Hullas Sehgal, Niskayuna, NY (US)

(73) Assignee: GE GLOBAL SOURCING LLC, Norwalk, CT (US)

( * ) Notice: Subject to any disclaimer, the term of this patent is extended or adjusted under 35 U.S.C. 154(b) by 28 days.

(21) Appl. No.: 15/705,752

(22) Filed: Sep. 15, 2017

(65) Prior Publication Data

US 2018/0022369 A1 Jan. 25, 2018

Related U.S. Application Data

(63) Continuation of application No. 15/061,212, filed on Mar. 4, 2016, now Pat. No. 9,764,748.

(60) Provisional application No. 62/281,429, filed on Jan. 21, 2016.

(51) Int. Cl.

| | |
|---|---|
| ***B61L 23/24*** | (2006.01) |
| ***B61L 23/34*** | (2006.01) |
| ***B61L 3/00*** | (2006.01) |
| ***B61L 25/02*** | (2006.01) |
| ***B61L 3/16*** | (2006.01) |
| ***B61L 15/00*** | (2006.01) |
| ***B61L 23/00*** | (2006.01) |

(52) U.S. Cl.

CPC ..... *B61L 23/34* (2013.01); *B61L 3/008* (2013.01); *B61L 3/16* (2013.01); *B61L 15/0009* (2013.01); *B61L 23/007* (2013.01); *B61L 25/021* (2013.01); *B61L 25/025* (2013.01); *B61L 2205/04* (2013.01)

(58) Field of Classification Search

CPC .. B61L 23/34; B61L 3/008; B61L 3/16; B61L 15/0009; B61L 23/007; B61L 25/021; B61L 25/025; B61L 2205/04

See application file for complete search history.

(56) References Cited

U.S. PATENT DOCUMENTS

| | | | | |
|---|---|---|---|---|
| 2005/0109548 | A1* | 5/2005 | Cooper | B62D 59/04 180/14.2 |
| 2008/0128562 | A1* | 6/2008 | Kumar | B61L 3/006 246/186 |
| 2009/0299555 | A1* | 12/2009 | Houpt | B61L 27/0027 701/19 |

(Continued)

*Primary Examiner* — Calvin Cheung

(74) *Attorney, Agent, or Firm* — Christopher R. Carroll; The Small Patent Law Group LLC

(57) ABSTRACT

A system includes a locator device and one or more processors operably connected to the locator device. The locator device determines a trailing distance between a trailing vehicle system that travels along a route and a leading vehicle system that travels along the route ahead of the trailing vehicle system in a same direction of travel. The one or more processors compare the trailing distance to a first proximity distance relative to the leading vehicle system. In response to the trailing distance being less than the first proximity distance, the one or more processors set a permitted power output limit for the trailing vehicle system to be less than a maximum achievable power output for the trailing vehicle system, the permitted power output limit being set based on a power-to-weight ratio of the leading vehicle system.

20 Claims, 6 Drawing Sheets

(56) References Cited

U.S. PATENT DOCUMENTS

| | | | | |
|---|---|---|---|---|
| 2011/0202212 | A1* | 8/2011 | Gatten | B60D 1/01 701/22 |
| 2013/0200222 | A1* | 8/2013 | Cooper | B61L 3/006 246/187 C |
| 2016/0318532 | A1* | 11/2016 | Brooks | B61L 27/0027 |

* cited by examiner

VEHICLE CONTROL SYSTEM

CROSS-REFERENCE TO RELATED APPLICATIONS

This application is a continuation of U.S. patent application Ser. No. 15/061,212, filed 4 Mar. 2016, which claims priority to U.S. Provisional Application No. 62/281,429, filed 21 Jan. 2016. The entire disclosures of the foregoing applications are incorporated herein by reference.

GOVERNMENT LICENSE RIGHTS

This invention was made with government support under DTFR-5314C00009 awarded by the Federal Railroad Administration. The government has certain rights in the invention.

FIELD

Embodiments of the subject matter described herein relate to vehicle control systems, and more particularly, to controlling a vehicle system relative to other vehicles, crossings, and/or work zones.

BACKGROUND

A vehicle transportation system may include multiple vehicles that travel on the same routes. The vehicles may have different characteristics, such as power outputs and weights, that affect how quickly the vehicles can navigate through the routes. A trailing vehicle traveling along a given route may reduce the distance between the trailing vehicle and a vehicle ahead along the same route that travels slower. The trailing vehicle has an incentive to reduce the total trip time in order to meet a designated arrival time at a destination, improve fuel economy, reduce emissions, and the like. However, if the trailing vehicle travels too closely to the vehicle ahead, the trailing vehicle may be required to slow to a stop for a designated period of time in order to avoid a risk of an accident between the two vehicles. The stop is undesirable as it may result in a significant delay and reduce fuel economy.

At least some of the routes over which vehicles travel may cross routes of other transportation systems, such as where rail tracks and road or highway systems cross over each other. To warn the vehicles of the other transportation systems, a vehicle approaching a crossing may be configured to activate a warning sound that is audible to people and animals near the crossing. Typically, the operator of a vehicle controls the warning sound in addition to other duties of the operator. It is not uncommon for the operator to make mistakes, such as to forget to activate the warning sound at the proper time, to activate the warning sound when not warranted (e.g., when the vehicle is in a quiet zone), or the like.

BRIEF DESCRIPTION

In an embodiment, a system (e.g., a vehicle control system) includes a locator device, a communication circuit, and one or more processors. The locator device is disposed onboard a trailing vehicle system that is configured to travel along a route behind a leading vehicle system that travels along the route in a same direction of travel as the trailing vehicle system. The locator device is configured to determine a location of the trailing vehicle system along the route. The communication circuit is disposed onboard the trailing vehicle system. The communication circuit is configured to periodically receive a status message that includes a location of the leading vehicle system. The one or more processors are onboard the vehicle system and are operably connected to the locator device and the communication circuit. The one or more processors are configured to verify that a power-to-weight ratio of the leading vehicle system is less than a power-to-weight ratio of the trailing vehicle system. The power-to-weight ratios of the leading vehicle system and the trailing vehicle system are based on respective upper power output limits of the leading and trailing vehicle systems. The one or more processors are further configured to monitor a trailing distance between the trailing vehicle system and the leading vehicle system based on the respective locations of the leading and trailing vehicle systems. Responsive to the trailing distance being less than a first proximity distance relative to the leading vehicle system, the one or more processors are configured to set an upper permitted power output limit for the trailing vehicle system that is less than the upper power output limit of the trailing vehicle system to reduce an effective power-to-weight ratio of the trailing vehicle system.

In another embodiment, a method (e.g., for controlling movement of a trailing vehicle system) includes determining a power-to-weight ratio of a leading vehicle system that is on a route and disposed ahead of a trailing vehicle system on the route in a direction of travel of the trailing vehicle system. The method includes verifying that the power-to-weight ratio of the leading vehicle system is less than a power-to-weight ratio of the trailing vehicle system. The power-to-weight ratios of the leading vehicle system and the trailing vehicle system are based on respective upper power output limits of the leading and trailing vehicle systems. The method also includes monitoring a trailing distance between the trailing vehicle system and the leading vehicle system along the route. The method further includes, responsive to the trailing distance being less than a first proximity distance relative to the leading vehicle system, setting an upper permitted power output limit that is less than the upper power output limit. An effective power-to-weight ratio of the trailing vehicle system based on the upper permitted power output limit is no greater than the power-to-weight ratio of the leading vehicle system.

BRIEF DESCRIPTION OF THE DRAWINGS

The present inventive subject matter will be better understood from reading the following description of non-limiting embodiments, with reference to the attached drawings, wherein below.

DETAILED DESCRIPTION

Figure 1:
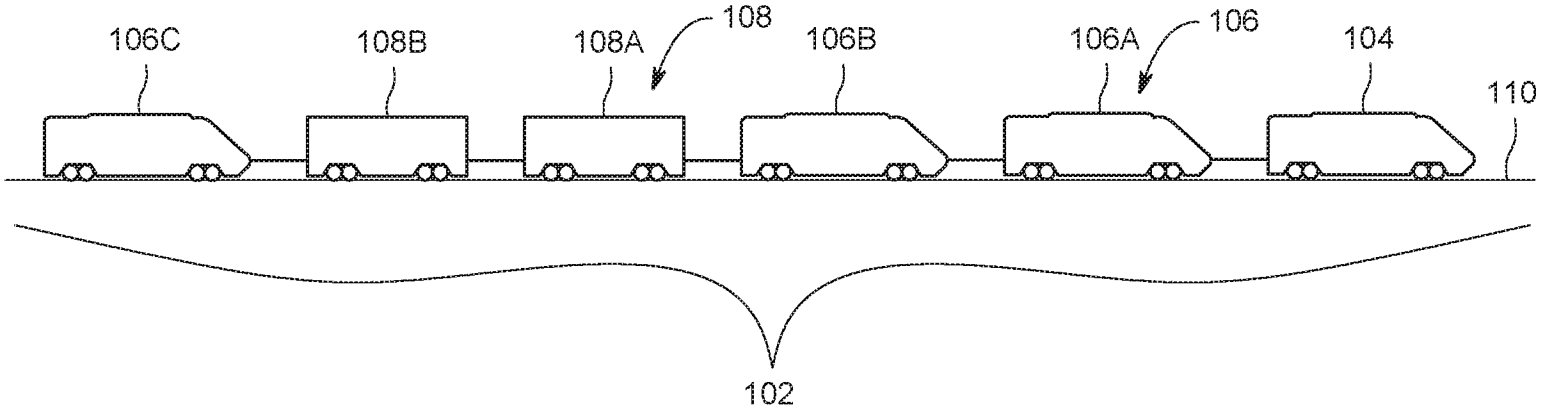
FIG. 1 illustrates a vehicle system in accordance with an embodiment.

One or more embodiments of the inventive subject matter described herein provide systems and methods for improved control of a vehicle system along a route. In various embodiments, an onboard system is provided that is configured to control movement of a vehicle system on a route relative to a vehicle ahead along the same route that is moving in the same direction. For example, the onboard system paces the vehicle system based on an acceleration capability of the vehicle ahead such that the vehicle system does not travel within a designated range of the vehicle ahead, which would require the vehicle system to stop or at least slow to increase the distance between the vehicles. A technical effect of such pacing is an increased overall throughput and efficiency along a network of routes as the trailing vehicle system is able to travel at a trailing distance behind the vehicle ahead that may be less than a trailing distance of the trailing vehicle system according to conventional pacing methods, such as relying on block signal aspects as described in more detail herein. Furthermore, such pacing increases the overall throughput and efficiency by avoiding delays that occur as a result of the trailing vehicle system traveling too closely to the vehicle ahead, which mandates that the trailing vehicle system slow to a stop or a low non-zero speed for a period of time before being allowed to accelerate up to a desired speed again. The stops and/or reduced speeds of the trailing vehicle system increase the travel time of the trailing vehicle system along the route and decrease the travel efficiency (e.g., increased fuel consumption, increased noise and exhaust emissions, etc.).

In various other embodiments, an onboard system is provided that is configured to control movement of a vehicle system on a route relative to an upcoming grade crossing. For example, the onboard system may operate an audible warning automatically without operator input as the vehicle system approaches the grade crossing. The characteristics of the audible warning, such as the whether or not to activate the warning, the volume of the warning, the start and end times of the warning, etc., are controlled by the onboard system. A technical effect of such automatic warning is a reduced operational load on the operator of the vehicle system and more consistent and accurate warning activations due to reduced human-involvement.

Various other embodiments described herein provide an onboard system that is configured to control movement of a vehicle system on a route relative to work zones and other special areas of interest along the route. For example, the onboard system may be configured to automatically update a trip plan according to which the vehicle system is traveling based on a received order, such as a temporary slow order. A technical effect of such automatic adjustment of the trip plan is improved control of the vehicle system through the special areas of interest.

Various other embodiments described herein provide an onboard system that is configured to automatically display improved information to an operator of a vehicle system. For example, the onboard system may display (on an onboard visual display) information about a route aspect, such as an upcoming signal. The information for an upcoming signal may include a distance to the signal, a time of arrival to the signal, a status of the signal (e.g., red over green indication, red over yellow indication, or green over green indication), the aspect of the signal (e.g., approach medium, clear, etc.), a type of the signal, and a physical layout of the signal. A technical effect of such automatic display of this improved information is allowing the operator to have advanced knowledge of the information prior to the vehicle system traveling within eyesight distance of the route aspect.

These and other embodiments are described in more detail herein with reference to the accompanying figures.

FIG. 1 illustrates one example of a vehicle system 102, in accordance with an embodiment. The illustrated vehicle system 102 includes propulsion-generating vehicles 104, 106 (e.g., vehicles 104, 106A, 106B, 106C) and non-propulsion-generating vehicles 108 (e.g., vehicles 108A, 108B) that travel together along a route 110. Although the vehicles 104, 106, 108 are shown as being mechanically coupled with each other, the vehicles 104, 106, 108 alternatively may not be mechanically coupled with each other. For example, at least some of the vehicles 104, 106, 108 may not be mechanically coupled to each other, but are still operatively coupled to each other such that the vehicles 104, 106, 108 travel together along the route 110 via a communication link or the like. The number and arrangement of the vehicles 104, 106, 108 in the vehicle system 102 are provided as one example and are not intended as limitations on all embodiments of the subject matter described herein. In the illustrated embodiment, the vehicle system 102 is shown as a rail vehicle system (e.g., train) such that the propulsion-generating vehicles 104, 106 are locomotives and the non-propulsion-generating vehicles 108 are rail cars. But, in other embodiments, the vehicle system 102 may be an aircraft, a water vessel, an automobile, or an off-highway vehicle (e.g., a vehicle system that is not legally permitted and/or designed for travel on public roadways).

Optionally, groups of one or more adjacent or neighboring propulsion-generating vehicles 104 and/or 106 may be referred to as a vehicle consist. For example the vehicles 104, 106A, 106B may be referred to as a first vehicle consist of the vehicle system 102 and the vehicle 106C referred to as a second vehicle consist of the vehicle system 102. The propulsion-generating vehicles 104, 106 may be arranged in a distributed power (DP) arrangement. For example, the propulsion-generating vehicles 104, 106 can include a lead vehicle 104 that issues command messages to the other propulsion-generating vehicles 106A, 106B, 106C, which are referred to herein as remote vehicles. The designations "lead" and "remote" are not intended to denote spatial locations of the propulsion-generating vehicles 104, 106 in the vehicle system 102, but instead are used to indicate which propulsion-generating vehicle 104, 106 is communicating (e.g., transmitting, broadcasting, or a combination of transmitting and broadcasting) command messages and which propulsion-generating vehicles 104, 106 are receiving the command messages and being remotely controlled using the command messages. For example, the lead vehicle 104 may or may not be disposed at the front end of the vehicle system 102 (e.g., along a direction of travel of the vehicle system 102). Additionally, the remote vehicles 106A-C need not be separated from the lead vehicle 104. For example, a remote vehicle 106A-C may be directly coupled with the lead vehicle 104 or may be separated from the lead vehicle 104 by one or more other remote vehicles 106A-C and/or non-propulsion-generating vehicles 108.

Figure 2:
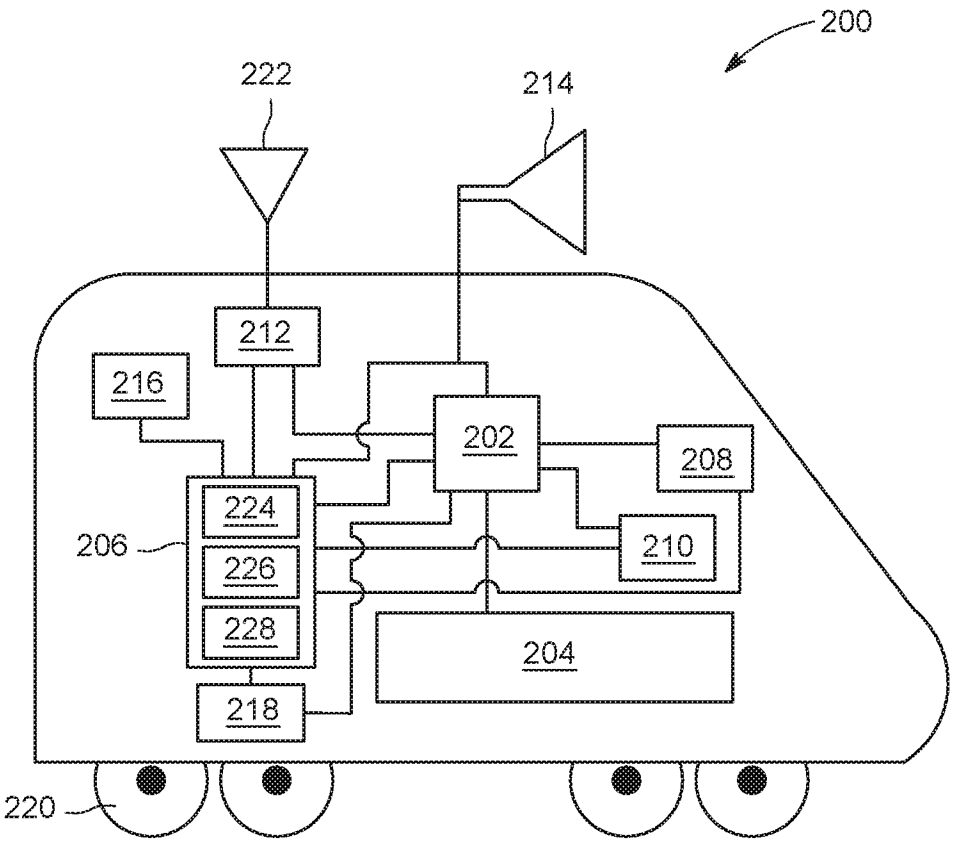
FIG. 2 is a schematic diagram of a vehicle system according to an embodiment.

FIG. 2 is a schematic diagram of a vehicle system 200 according to an embodiment. The vehicle system 200 may be the vehicle system 102 shown in FIG. 1 that includes multiple vehicles, although only one vehicle is shown in FIG. 2. For example, the illustrated vehicle in FIG. 2 may be one of the propulsion-generating vehicles 104, 106 shown in FIG. 1. The vehicle system 200 in the illustrated embodiment includes a vehicle controller 202, a propulsion system 204, a trip planning controller 206, a display device 208, a manual input device 210, a communication circuit 212, an audible warning emitter 214, a locator device 216, and speed sensor 218. The vehicle system 200 may include additional components, fewer components, and/or different components than the illustrated components in other embodiments. Although all of the components of the vehicle system 200 in the illustrated embodiment are located on the same vehicle, optionally at least some of the components are distributed among plural vehicles of the vehicle system 200.

The vehicle controller 202 controls various operations of the vehicle system 200. The controller 202 may include or represent one or more hardware circuits or circuitry that include and/or are connected with one or more processors, controllers, or other hardware logic-based devices. For example, the controller 202 in an embodiment has one or more processors. The controller 202 is operatively connected with the propulsion system 204 in order to control the propulsion system 204. The propulsion system 204 may provide both propelling efforts and braking efforts for the vehicle system 200. The controller 202 may be configured to generate control signals autonomously or based on manual input that is used to direct operations of the propulsion system 204, such as to control a speed of the vehicle system 200. The vehicle controller 202 optionally may also control auxiliary loads of the vehicle system 200, such as heating, ventilation, and air-conditioning (HVAC) systems, lighting systems, and the like.

The propulsion system 204 includes propulsion-generating components, such as motors, engines, generators, alternators, turbochargers, pumps, batteries, turbines, radiators, and/or the like, that operate to provide power generation under the control implemented by the controller 202. The propulsion system 204 provides tractive effort to power wheels 220 of the vehicle system 200 to move the vehicle system 200 along the route. In another embodiment, the propulsion system 204 may include tracks that engage the route instead of the wheels 220 shown in FIG. 2. In a marine vessel embodiment, the propulsion system 204 may include one or more propellers instead of the wheels 220 to propel the vehicle system 200 through the water. The propulsion system 204 also includes brakes and affiliated components that are used to slow the vehicle system 204.

The speed sensor 218 is configured to monitor a speed of the vehicle system 200 along the route. The speed sensor 218 may monitor the speed by measuring the movement of one or more components, such as the rotational speed of one of the wheels 220 that engage the route, the rotational speed of a drive shaft (not shown), or the like. The speed sensor 218 is communicatively connected to the vehicle controller 202 and/or the trip planning controller 206 to communicate speed measurement signals for analysis. Although only the speed sensor 218 is shown in FIG. 2, the vehicle system 200 may include additional sensors (not shown), such as additional speed sensors, pressure sensors, temperature sensors, position sensors, gas and fuel sensors, acceleration sensors, and/or the like. The sensors are configured to acquire operating parameters of various components of the vehicle system 200 and communicate data measurement signals of the operating parameters to the vehicle controller 202 and/or the trip planning controller 206 for analysis.

The display device 208 is configured to be viewable by an operator of the vehicle system 200, such as a conductor or engineer. The display device 208 includes a display screen, which may be a liquid crystal display (LCD), a light emitting diode (LED) display, an organic light emitting diode (OLED) display, a plasma display, a cathode ray tube (CRT) display, and/or the like. The display device 208 is communicatively connected to the vehicle controller 202 and/or the trip planning controller 206. For example, the vehicle controller 202 and/or the trip planning controller 206 can present information to the operator via the display device 208, such as status information, operating parameters, a map of the surrounding environment and/or upcoming segments of the route, notifications regarding speed limits, work zones, and/or slow orders, and the like.

The manual input device 210 is configured to obtain manually input information from the operator of the vehicle system 200, and to convey the input information to the vehicle controller 202 and/or the trip planning controller 206. The manually input information may be an operator-provided selection, such as a selection to limit the throttle settings of the vehicle system 200 along a segment of the route due to a received slow order, for example. The operator-provided selection may also include a selection to activate the audible warning emitter 214, to control the communication circuit 212 to communicate a message remotely to another vehicle, to a dispatch location, or the like, or to actuate the brakes to slow and/or stop the vehicle system 200. The manual input device 210 may be a keyboard, a touchscreen, an electronic mouse, a microphone, a wearable device, or the like. Optionally, the manual input device 210 may be housed with the display device 208 in the same case or housing. For example, the input device 210 may interact with a graphical user interface (GUI) generated by the vehicle controller 202 and/or the trip planning controller 206 and shown on the display device 206.

The communication circuit 212 is operably connected to the vehicle controller 202 and/or the trip planning controller 206. The communication circuit 212 may represent hardware and/or software that is used to communicate with other devices and/or systems, such as remote vehicles or dispatch stations. The communication circuit 212 may include a transceiver and associated circuitry (e.g., an antenna 222) for wireless bi-directional communication of various types of messages, such as linking messages, command messages, reply messages, status messages, and/or the like. The communication circuit 212 may be configured to transmit messages to specific designated receivers and/or to broadcast messages indiscriminately. Optionally, the communication circuit 212 also includes circuitry for communicating messages over a wired connection, such as an electric multiple unit (eMU) line (not shown) between vehicles of a vehicle system 200, a catenary line or conductive rail of a track, or the like.

The locator device 216 is configured to determine a location of the vehicle system 200 along the route. The locator device 216 may be a GPS receiver or a system of sensors that determine a location of the vehicle system 200. Examples of such other systems include, but are not limited to, wayside devices, such as radio frequency automatic equipment identification (RF AEI) tags and/or video-based determinations. Another system may use a tachometer and/or speedometer aboard a propulsion-generating vehicle and distance calculations from a reference point to calculate a current location of the vehicle system 200. The locator device 216 may be used to determine the proximity of the vehicle system 200 along the route from one or more crossings in the route, from one or more other vehicles on the route, from a work zone or another speed-restricted zone, from a quiet zone, or the like.

The audible warning emitter 214 is configured to provide an audible warning sound to alert people and animals of the approaching vehicle system 200. The audible warning emitter 214 may be a horn, a speaker, a bell, a whistle, or the like. The audible warning emitter 214 is operably controlled automatically by the vehicle controller 202 and/or the trip planning controller 206. The emitter 214 may be controlled manually by the operator using the manual input device 210. The manual control of the emitter 214 may override the automatic control of the emitter 214. For example, the operator is able to activate the emitter 214 when the emitter 214 is being automatically controlled by the controller 202 and/or the controller 206.

The trip planning controller 206 of the vehicle system 200 may be configured to receive, generate, and/or implement a trip plan that controls movements of the vehicle system 200 along the route to improve one or more operating conditions while abiding by various prescribed constraints. The trip planning controller 206 includes one or more processors 224, such as a computer processor or other logic-based device that performs operations based on one or more sets of instructions (e.g., software). The instructions on which the controller 206 operates may be stored on a tangible and non-transitory (e.g., not a transient signal) computer readable storage medium, such as a memory 226. The memory 226 may include one or more computer hard drives, flash drives, RAM, ROM, EEPROM, and the like. Alternatively, one or more of the sets of instructions that direct operations of the controller 206 may be hard-wired into the logic of the controller 206, such as by being hard-wired logic formed in the hardware of the controller 206.

The trip planning controller 206 may receive a schedule from an off-board scheduling system. The trip planning controller 206 may be operatively coupled with, for example, the communication circuit 212 to receive an initial and/or modified schedule from the scheduling system. In an embodiment, the schedules are conveyed to the controller 206, and may be stored in the memory 226. Alternatively, the schedule may be stored in the memory 226 of the trip planning controller 206 via a hard-wired connection, such as before the vehicle system 200 starts on a trip along the route. The schedule may include information about the trip, such as the route to use, the departing and destination locations, the desired total time of travel, the desired arrival time at the destination location and optionally at various checkpoint locations along the route, the location and time of any meet and pass events along the route, and the like.

In an embodiment, the trip planning controller 206 (including the processors 224 thereof) generates a trip plan based on the schedule. The trip plan may include throttle settings, brake settings, designated speeds, or the like, of the vehicle system 200 for various segments of the route during a scheduled trip or mission of the vehicle system 300 to the scheduled destination location. The trip plan may be generated to reduce the amount of fuel that is consumed by the vehicle system 200 and/or the amount of emissions generated by the vehicle system 200 as the vehicle system 200 travels to the destination location relative to travel by the vehicle system 200 to the destination location when not abiding by the trip plan. Controlling the vehicle system 200 according to the trip plan may result in the vehicle system 200 consuming less fuel and/or generating fewer emissions to reach a destination location than if the same vehicle system 200 traveled along the same routes to arrive at the same destination location at the same time as the trip plan (or within a relatively small time buffer, such as one to three or five percent of the total trip time, or another relatively small percentage), but traveling at speed limits (e.g., track speed) of the routes.

In order to generate the trip plan for the vehicle system 200, the trip planning controller 206 can refer to a trip profile that includes information related to the vehicle system 200, information related to a route over which the vehicle system 200 travels to arrive at the scheduled destination, and/or other information related to travel of the vehicle system 200 to the scheduled destination location at the scheduled arrival time. The information related to the vehicle system 200 may include information regarding the fuel efficiency of the vehicle system 200 (e.g., how much fuel is consumed by the vehicle system 200 to traverse different sections of a route), the tractive power (e.g., horsepower) of the vehicle system 200, the weight or mass of the vehicle system 200 and/or cargo, the length and/or other size of the vehicle system 200, the location of powered units in the vehicle system 200, and/or other information. The information related to the route to be traversed by the vehicle system 200 can include the shape (e.g., curvature), incline, decline, and the like, of various sections of the route, the existence and/or location of known slow orders or damaged sections of the route, and the like. Other information can include information that impacts the fuel efficiency of the vehicle system 200, such as atmospheric pressure, temperature, precipitation, and the like. The trip profile may be stored in the memory 226 of the trip planning controller 206.

The trip plan is formulated by the trip planning controller 206 (e.g., by the one or more processors 224) based on the trip profile. For example, if the trip profile requires the vehicle system 200 to traverse a steep incline and the trip profile indicates that the vehicle system 200 is carrying significantly heavy cargo, then the one or more processors 224 may generate a trip plan that includes or dictates increased tractive efforts for that segment of the trip to be provided by the propulsion system 204 of the vehicle system 200. Conversely, if the vehicle system 200 is carrying a smaller cargo load and/or is to travel down a decline in the route based on the trip profile, then the one or more processors 224 may form a trip plan that includes or dictates decreased tractive efforts by the propulsion system 204 for that segment of the trip. In an embodiment, the trip planning controller 206 includes a software application or system such as the Trip Optimizer™ system provided by General Electric Company. The trip planning controller 206 may directly control the propulsion system 204, may indirectly control the propulsion system 204 by providing control commands to the vehicle controller 202, and/or may provide prompts to an operator for guided manual control of the propulsion system 204.

The trip planning controller 206 further includes a clock 228 that is synchronized to a common timing scheme. In some embodiments, the clock 228 may be operatively connected to a GPS receiver of the locator device 216 to provide an absolute time based on a GPS signal. The clock 228 provides the trip planning controller 206 with information about the time of day.

In the illustrated embodiment, the one or more processors 224, the memory 226, and the clock 228 are all contained within the trip planning controller 206. In one embodiment, the processor(s) 224, the memory 226, and the clock 228 are all housed within a common hardware housing or case. In an alternative embodiment, however, these components are not all housed within a common housing, such that at least one of the processor(s) 224, the memory 226, or the clock 228 is disposed in a separate housing or case from the other component(s) of the trip planning controller 206.

Figure 3:
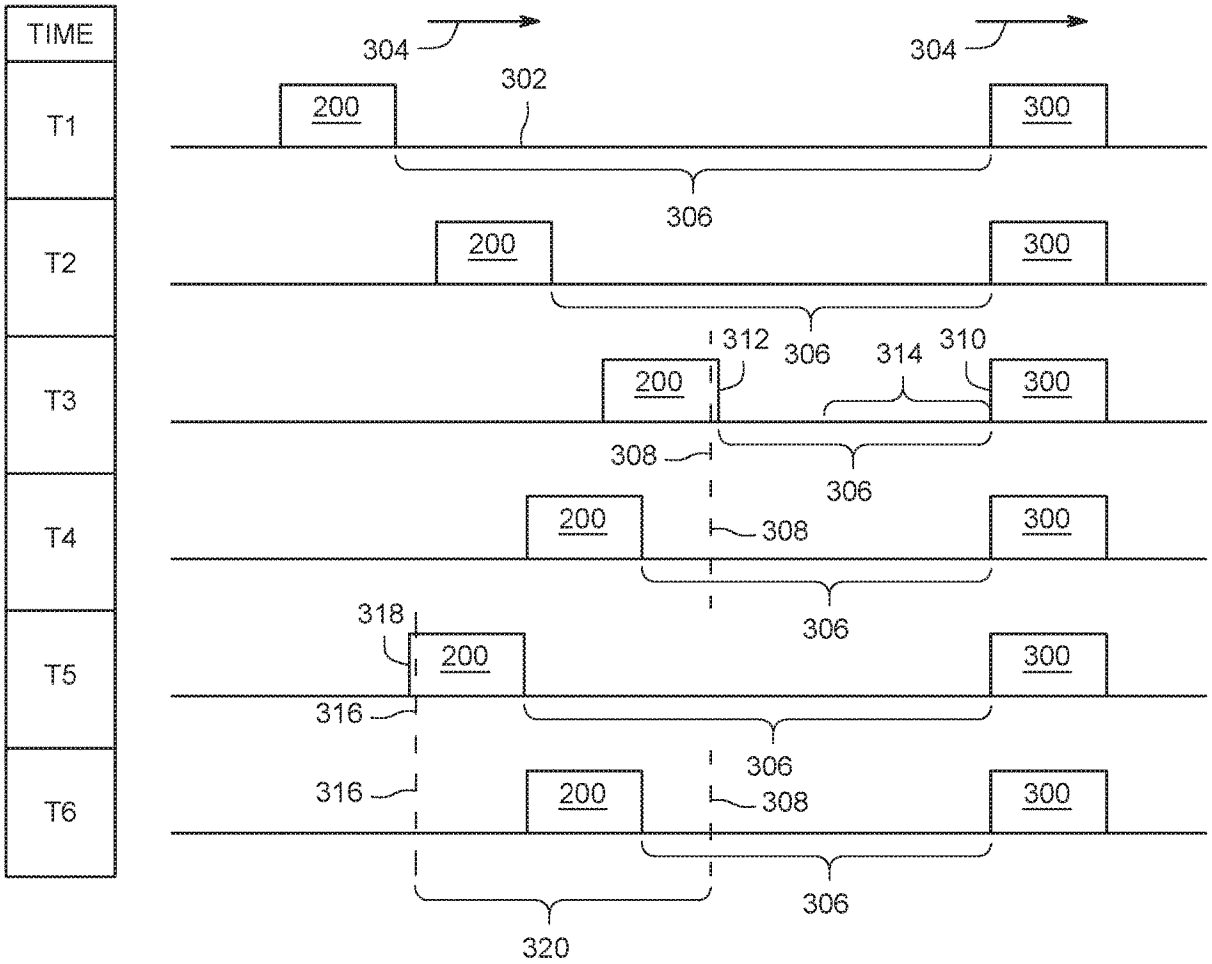
FIG. 3 is a schematic diagram showing a trailing vehicle system and a leading vehicle system ahead of the trailing vehicle system along a route at different times during a trip of the trailing vehicle system.
Figure 4:
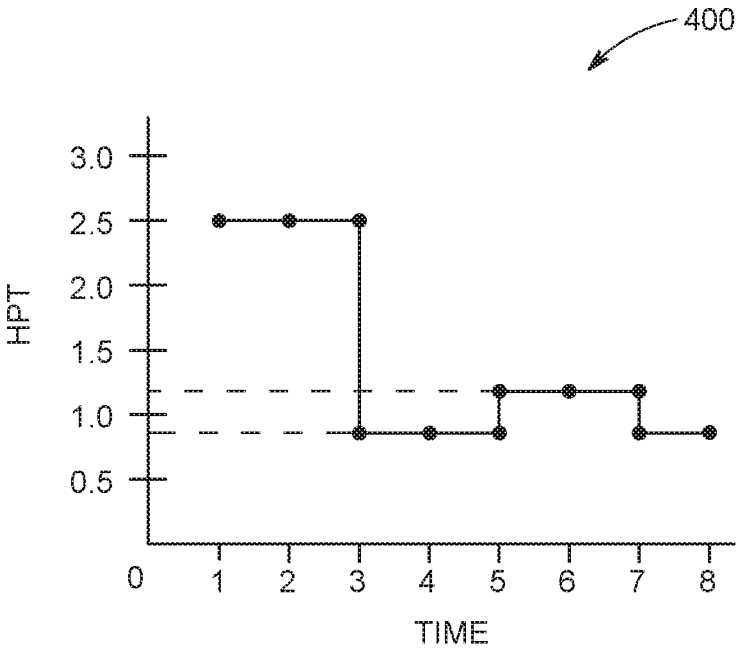
FIG. 4 is a graph of horsepower per tonnage (HPT) of the vehicle system over time during the trip of the vehicle system shown in FIG. 3.

FIG. 3 is a schematic diagram showing the vehicle system 200 and a leading vehicle system 300 ahead of the vehicle system 200 along a route 302 at different times during a trip of the vehicle system 200. FIG. 4 is a graph 400 of horsepower per tonnage (referred to herein as "HPT") of the vehicle system 200 over time during the trip of the vehicle system 200 shown in FIG. 3. The information presented in FIGS. 3 and 4 is merely for illustration and is not intended to be limiting.

The HPT of the vehicle system 200 is a performance indicator of the vehicle system 200. The HPT is a power-to-weight ratio that indicates an acceleration capability of the vehicle system 200. The HPT is calculated as the total (available) horsepower of a vehicle system divided by the weight or tonnage of the vehicle system. The total horsepower of the vehicle system is determined as the sum of the horsepower provided by the propulsion system (such as the propulsion system 204 shown in FIG. 2) of each propulsion-generating vehicle in the vehicle system. For example, a vehicle system having two propulsion-generating vehicles that each can provide 6,000 horsepower (e.g., 4500 kW) has a total vehicle system horsepower of 12,000. The weight or tonnage of the vehicle system is the total weight of the vehicle system along the route, which is the sum of the weight of each of the vehicles in the vehicle system including weight attributable to cargo and/or passengers. For example, a vehicle system that includes two propulsion generating vehicles that each weigh 250 tons and fifty-five non-propulsion generating vehicles that each weigh 100 tons would have an HPT of 2.0 (e.g., calculated as $12{,}000/((2\times 250)+(55\times 100))=2.0$ HP/T). Since the HPT is determined as a function of both power and weight, a first vehicle system that has twice the horsepower and also twice the weight as a second vehicle system would have the same HPT as the second vehicle system. Instead of horsepower over tonnage, the power-to-weight ratio can be represented as horsepower over pounds, kilowatts over kilograms, or the like.

A higher HPT indicates a greater acceleration capability. For example, a first vehicle system with a higher HPT than a second vehicle system would be able to traverse up a hill faster than the second vehicle system because the first vehicle system is able to generate a greater acceleration up the hill. The HPT can also affect the total travel time for a given trip. For example, the first vehicle system having the greater HPT would be able to traverse a given route faster than the second vehicle system, resulting in a lower total travel time than the second vehicle system. Therefore, a trailing vehicle system that has a greater HPT than a leading vehicle system traveling along the same route ahead of the trailing vehicle system has the ability to travel faster than the leading vehicle, at least along flat and inclined segments of the route. The trailing vehicle system may travel at a greater actual or effective power-to-weight ratio than the leading vehicle system, which causes the trailing vehicle to reduce the gap or trailing distance that separates the two vehicle systems.

Assuming there is no meet and pass event scheduled, if the trailing vehicle system gets too close to the leading vehicle system ahead, as a safety precaution the trailing vehicle system may be forced to slow to a stop or a significantly low speed (e.g., 2 miles per hour (mph), 5 mph, 10 mph, or the like) in order to increase the gap between the two vehicle systems. Forcing the trailing vehicle system to come to a stop or to slow to a significantly low speed is inefficient as it lowers throughput along the route, reduces fuel economy of the trailing vehicle system, increases the length of time of the trip of the trailing vehicle system, and/or the like. Prior to being forced to slow and/or stop, the trailing vehicle system may have been traveling over the route according to a designated trip plan that is configured to reduce energy consumption, emissions, noise, travel time, and/or the like. The trip plan may not have accounted for the leading vehicle system traveling slower along the route. The requirement for the trailing vehicle system to slow and/or stop due to proximity to the leading vehicle system causes the trailing vehicle system to deviate from the designated trip plan until the trailing vehicle system is allowed to return to speed.

In one or more embodiments described herein, the trip planning controller 206 (shown in FIG. 2) of the vehicle system 200 is configured to account for vehicle systems ahead of the vehicle system 200 along the same route that have a lower HPT than the vehicle system 200. For example, the trip planning controller 206 is able to pace the vehicle system 200 based on the leading vehicle system ahead of the vehicle system 200. The adopted pace of the vehicle system 200 is likely slower overall than the speed profile at which the vehicle system 200 would traverse the route without a leading vehicle system on the route, but the pace of the vehicle system 200 is designed to avoid the need to stop and/or slow to a significantly low speed. Thus, the total travel time, fuel consumption, and/or emissions would likely be lower by pacing than if the vehicle system 200 travels according to a designated trip plan that does not account for the leading vehicle and results in the vehicle system 200 being forced to stop and/or slow considerably at least once during the trip.

FIG. 3 shows the vehicle system 200 and the vehicle system 300 along the route 302 at six different times (e.g., T1, T2, T3, T4, T5, T6) during a trip of the vehicle system 200. Both vehicle systems 200, 300 travel in the same direction 304 along the route 302. The vehicle system 300 is referred to as the leading vehicle system 300, and the vehicle system 200 is referred to as the trailing vehicle system 200. FIG. 3 shows how the relative distance between the leading and trailing vehicle systems 300, 200 changes over time. Thus, although the leading vehicle system 300 is shown in the same location at each time, it is assumed that the leading vehicle system 300 is constantly moving and therefore the location of the vehicle system 300 relative to the route 302 is different at each time. The distance between the leading vehicle system 300 and the trailing vehicle system 200 is referred to as the trailing distance 306 or gap. The different times may represent various increments of time, such as minutes, hours, or tens of hours. For example, the time that elapses between times T1 and T2 may be one hour, two hours, five hours, or the like. The time increments may be constant between times T1 and T6, but optionally are not constant.

In the illustrated embodiment, the leading vehicle system 300 has an HPT of 1.0 and the trailing vehicle system 200 has an HPT of 2.5. Therefore, the HPT of the trailing vehicle system 200 is greater than the HPT of the leading vehicle system 300. These values represent the capabilities of these vehicle systems 200, 300. For example, the HPT of 2.5 corresponds to an upper power output limit of the trailing vehicle system 200. The trailing vehicle system 200 cannot exert more horsepower than the 2.5 times the weight of the vehicle system 200. Likewise, the leading vehicle system 300 cannot exceed the 1.0 power-to-weight ratio.

It is recognized that each of the vehicle systems 200, 300 may travel along different segments of the route at different power outputs depending on route characteristics and other factors, such that the vehicle systems 200, 300 may often provide a current power output that is less than the respective upper power output limit. For example, the trailing vehicle system 200 may have an upper power output limit of 12,000 horsepower, but generates less than 12,000 horsepower along various segments of the route according to the trip plan. The trip plan designates throttle and brake settings of the vehicle system 200 during the trip based on time or location along the route. The throttle settings may be notch settings. In one embodiment, the throttle settings include eight notch settings, where Notch 1 is the low throttle setting and Notch 8 is the top throttle setting. Notch 8 corresponds to the upper power output limit, which is 12,000 horsepower in one embodiment. Thus, when the vehicle system 200 operates at Notch 8, the vehicle system 200 provides a power output at the upper power output limit (which is associated with the HPT of the vehicle system 200). During a trip, the trip plan may designate the vehicle system 200 to travel at Notch 5 along a first segment of the route, at Notch 7 along a second segment of the route, and at Notch 8 along a third segment of the route. As such, the vehicle system 200 is controlled to generate a power output that varies over time and/or distance along the route. The generated power output may be equal to the upper power output limit at some locations (e.g., along the third segment of the route) and lower than the upper power output limit at other locations (e.g., along the first and second segments).

In the pacing embodiment described in FIGS. 3 and 4, the trailing vehicle system 200 is configured to move automatically according to the leading vehicle system 300. Thus, the trailing vehicle system 200 alters the movements of the vehicle system 200 along the route 302 based on the movement and characteristics of the leading vehicle system 300, but the leading vehicle system 300 does not move based on the trailing vehicle system 200. For example, the trailing vehicle system 200 is configured to determine the HPT of the leading vehicle system 300. The trailing vehicle system 200 may determine the HPT of the leading vehicle system 300 based on a received message. The communication circuit 212 (shown in FIG. 2) may receive a wireless message from the leading vehicle system 200, from a dispatch location, or from another remote source that indicates that the HPT of the leading vehicle system 300 is 1.0. In an alternative embodiment, the identification and HPT of the leading vehicle system 300 may be stored in the memory 226 (shown in FIG. 2) of the vehicle system 200 prior to the trip. The trailing vehicle system 200 also receives status messages that indicate the location of the leading vehicle system 300. For example, the leading vehicle system 300 may transmit the current location of the leading vehicle system 300 to the trailing vehicle system 200 periodically (e.g., every 10 seconds, every 30 seconds, every minute, every 5 minutes, etc.) or responsive to receiving a request from the trailing vehicle system 200. The leading vehicle system 300 may transmit the updated location of the leading vehicle system 300 wirelessly or conductively along a catenary wire or a conductive track of the route 302. Optionally, a dispatch or another off-board source may communicate the updated location of the leading vehicle system 300 to the trailing vehicle system 200, either periodically or upon each request. In another example, the trailing vehicle system 200 may dispatch an aerial device (not shown), such as a drone, that is configured to fly remotely from the vehicle system 200 to the leading vehicle system 300 in order to monitor the location of the leading vehicle system 300.

FIG. 4 shows the effective HPT of the trailing vehicle system 200 over time. The "effective" HPT, as used herein, is a power-to-weight ratio that is calculated based on an upper "permitted" power output limit for the trailing vehicle system 200. The upper permitted power output limit is a selected or designated limit that may be equal to or less than the upper power output limit that is based on the capabilities of the vehicle system 200. Thus, although the vehicle system 200 may be capable of providing 12,000 horsepower at the top throttle setting that corresponds to the upper power output limit that is achievable by the vehicle system 200, the upper power output limit may be selectively lowered (as described below) to a lower power output, such as by limiting the throttle settings to avoid at least the top throttle setting. When the upper permitted power output limit is less than the upper power output limit, the effective power-to-weight ratio calculated based on the upper permitted power output limit is less than the power-to-weight ratio based on the upper power output limit. The HPT values plotted in the graph 400 represent upper limits and not actual power outputs provided by the vehicle system 200.

As shown in the graph 400, the trailing vehicle system 200 travels along the route 302 according to an effective HPT of 2.5 between times T1 and T2. Thus, although the effective HPT based on the upper permitted power output limit is 2.5 between times T1 and T2, the actual power output generated during at least a portion of the period may be less than the upper permitted power output limit. As shown in FIG. 3, the trailing distance 306 between the two vehicle systems 200, 300 decreases from time T1 to time T2. The reduced trailing distance 306 is attributable to the trailing vehicle system 200 traveling faster than the leading vehicle system 300 due to a greater effective HPT than the leading vehicle system 300, which is limited to the HPT value of 1.0. The trailing vehicle system 200 is able to determine the trailing distance 306 based on the known location of the trailing vehicle system 200 (e.g., using the locator device 216 shown in FIG. 2) and the location of the leading vehicle system 300 as received in a message from the leading vehicle system 300, a dispatch location, an aerial device, or the like.

Between times T2 and T3, the trailing vehicle system 200 continues to make up ground on the leading vehicle system 300. At time T3, the trailing vehicle system 200 crosses a first proximity threshold 308 relative to the leading vehicle system 300. The first proximity threshold 308 is disposed rearward from a rear end 310 of the leading vehicle system 300. The first proximity threshold 308 is located a first proximity distance from the leading vehicle system 300. In an embodiment, the trailing vehicle system 200 crosses the proximity threshold 308 upon a front end 312 of the vehicle system 200 extending beyond the threshold 308. Alternatively, the trailing vehicle system 200 crosses the proximity threshold 308 upon a rear end 318 of the vehicle system 200 or a designated vehicle in the vehicle system 200 extending beyond the threshold 308. The trailing vehicle system 200 is able to determine when the front end 312 crosses the proximity threshold 308 when the calculated trailing distance 306 is less than the first proximity distance between the proximity threshold 308 and the leading vehicle system 300. The first proximity distance may be a known, static parameter that is stored in the memory 226 of the trip planning controller 206 or received by the trailing vehicle system 200 via the communication circuit 212. Alternatively, the location of the proximity threshold 308 relative to the leading vehicle system 300 may be adjusted based on the speed of the leading vehicle system 300 and/or the speed of the trailing vehicle system 200. For example, the proximity threshold 308 may be located farther from the leading vehicle system 300 as the speed of the leading vehicle system 300 and/or the trailing vehicle system 200 increases, due to a greater stopping distance that is necessary at higher speeds.

The first proximity distance relative to the leading vehicle system 300 is greater than an automatic slowdown range 314 that extends rearward from the leading vehicle system 300. If the trailing vehicle system 200 enters the automatic slowdown range 314, the trailing vehicle system 200 is required to immediately slow to a stop or a non-zero low speed in order to avoid an accident. The trailing vehicle system 200 is configured to cross the first proximity threshold 308 prior to entering the automatic slowdown range 314. Thus, by selectively limiting the power output of the trailing vehicle system 200 based on the HPT of the leading vehicle system 300 upon crossing the proximity threshold 308, the trailing vehicle system 200 is configured to avoid entering the automatic slowdown range 314.

The first proximity distance between the first proximity threshold 308 and the leading vehicle system 300 optionally may be calculated as a sum of a safe braking distance, a response time distance, and a safety margin distance. The safe braking distance represents the distance along the path of the route that the trailing vehicle system 200 would move before stopping in response to engagement of one or more brakes of the vehicle system 200. For example, if the trailing vehicle system 200 were to engage air brakes, the safe braking distance represents how far the trailing vehicle system 200 would continue to move subsequent to engaging the brakes before stopping all movement. The response time distance represents the distance along the path of the route that the trailing vehicle system 200 would travel before an operator onboard the trailing vehicle system 200 could engage the brakes in response to identifying an event that would cause application of the brakes, such as an obstacle on the route and/or damage to the route. The safety margin distance is additional distance along the route intended for safety. Thus, if the actual response time distance before applying the brakes is greater than the anticipated response time distance, the safety margin is able to accommodate the extra distance that the trailing vehicle system 200 would travel before stopping without resulting in an accident between the trailing vehicle system 200 and the leading vehicle system 300. Alternatively, the location of the proximity threshold 308 may be a function of an installed signaling system (e.g., a function of block size) or a function of other relevant locations. For example, the first proximity distance may be the distance of a single block or two blocks along the path of the route.

In response to crossing the proximity threshold 308, the trip planning controller 206 (shown in FIG. 2) is configured to set or designate an upper permitted power output limit for the trailing vehicle system 200 that is less than the upper power output limit (that is achievable based at least in part on the hardware of the vehicle system 200). The trailing vehicle system 200 crosses the proximity threshold 308 when the trailing distance is less than the first proximity distance relative to the leading vehicle system 300. Thus, if the upper power output limit is 12,000 horsepower, the upper permitted power output limit may be reduced to 8,000 horsepower. The upper power output limit may be reduced by limiting the throttle settings used to control the movement of the vehicle system 200 along the route. For example, since the top throttle setting is associated with the upper power output limit, the upper permitted power output limit may restrict the use of at least the top throttle setting, and potentially multiple throttle settings at the top range of the available throttle settings.

In an embodiment, the upper permitted power output limit is set such that the effective power-to-weight ratio of the trailing vehicle system that is calculated based on the upper permitted power output limit is not greater than the power-to-weight ratio of the leading vehicle system 300. Thus, the upper permitted power output limit divided by the weight of the vehicle system 200 is less than or equal to the power-to-weight ratio of the leading vehicle system 300. Upon setting the upper permitted power output limit, the trip planning controller 206 controls the movement of the trailing vehicle system 200 according to the upper permitted power output limit, such that the power output generated by the vehicle system 200 does not exceed the upper permitted power output limit.

At time T3, the trailing vehicle system 200 sets the upper permitted power output limit such that the effective HPT based on the upper permitted power output limit is less than or equal to the HPT of the leading vehicle system 300. Since the HPT of the leading vehicle system 300 is 1.0, the trailing vehicle system 200 lowers the upper power output limit to a level that does not exceed a resulting HPT of 1.0 for the trailing vehicle system 200. For example, throttle setting Notch 3 may generate a power output (e.g., 3840 horsepower) that provides an HPT of 0.8 and throttle setting Notch 4 may generate a power output (e.g., 5760 horsepower) that provides an HPT of 1.2. Therefore, since setting Notch 4 as the upper permitted limit would exceed the power-to-weight ratio of the leading vehicle 300, the Notch 3 throttle setting is the highest throttle setting that is less than the power-to-weight ratio of the leading vehicle system 300. As a result, the trip planning controller 206 is configured to set the upper permitted power output limit to 3840 horsepower and/or Notch 3. As the trailing vehicle system 300 continues to move along the route, the trip planning controller 206 limits the usable throttle settings to Notch 1, Notch 2, and Notch 3 for controlling the vehicle system 300. As shown in FIG. 4, the effective HPT at time T3 drops from 2.5 to 0.8 , based on the adjustment to the upper permitted power output limit.

From times T3 to T5, as shown in FIGS. 3 and 4, the trailing vehicle system 200 travels along the route 302 with an effective HPT of 0.8. Since the leading vehicle system 300 travels at an HPT of 1.0 that is greater than the current HPT of the trailing vehicle system 200, the leading vehicle system 300 may travel at an average speed from times T3 to T5 that is greater than the average speed of the trailing vehicle system 200, and the trailing distance 306 may gradually increase.

Optionally, the trip planning controller 206 of the trailing vehicle system 200 demarcates a second proximity threshold 316 relative to the leading vehicle system 300. The second proximity threshold 316 is located a second proximity distance from the leading vehicle system 300. The second proximity distance is greater than the first proximity distance between the vehicle system 300 and the first proximity threshold 308. The first proximity threshold 308 is referred to herein as a near threshold 308, and the second proximity threshold 316 is referred to herein as a far threshold 316. In an embodiment, as the trailing vehicle system 200 travels along the route 302 with the upper permitted power output limit that is associated with an HPT of 0.8 and the trailing distance 306 relative to the leading vehicle system 300 increases, eventually the trailing vehicle system 200 crosses the far threshold 316 such that a portion of the vehicle system 200 is farther from the leading vehicle system 300 than the far threshold 316. Although FIG. 3 depicts a rear end 318 of the trailing vehicle system 200 crossing the far threshold 316, in an alternative embodiment the far threshold 316 may be effectively crossed upon the front end 312 or another portion of the trailing vehicle system 200 extending beyond the far threshold 316. In response to the trailing vehicle system 200 crossing the far threshold 316, the trip planning controller 206 of the trailing vehicle system 200 is configured to increase the upper permitted power output limit of the vehicle system 200 such that the effective HPT is greater than the HPT of the leading vehicle system 300. For example, the trip planning controller 206 may increase the top permitted throttle setting to Notch 4, which is associated with an HPT of 1.2. Optionally, the top permitted throttle setting may be increased even higher, such as to Notch 5, Notch 6, Notch 7, or Notch 8. Thus, in one embodiment the trip planning controller 206 may increase the top permitted throttle setting such that the resulting effective HPT is slightly greater than the HPT of the leading vehicle system 300. But, in an alternative embodiment, the trip planning controller 206 may increase the effective HPT of the trailing vehicle system 200 to the attainable HPT of 2.5. Still, upon the trailing vehicle system 200 crossing the near threshold 308, the trip planning controller 206 is configured to lower the upper permitted power output limit once again such that the effective HPT is lower than or equal to the HPT of the leading vehicle system 300.

As shown in FIG. 4, from times T5 to T6 the trailing vehicle system 200 travels at an upper permitted power output limit that corresponds to an HPT of 1.2. Since the effective HPT of the trailing vehicle system 200 is once again greater than the HPT of the leading vehicle system 300 (e.g., at 1.0), the trailing vehicle system 200 may begin to reduce the trailing distance 306. The distance between the near threshold 308 and the far threshold 316 is a pacing range 320. The pacing range 320 is the area relative to the leading vehicle system 300 that the trailing vehicle system 200 is controlled to generally stay within in order to keep pace with the leading vehicle system 300. Although not shown in FIG. 3, eventually the trailing vehicle system 200 traveling according to an HPT of 1.2 will reduce the trailing distance 306 to a degree that the trailing vehicle system 200 crosses the near threshold 308 again. As shown in FIG. 4, the trailing vehicle system 200 crosses the near threshold 308 at time T7, and, in response, the trip planning controller 206 reduces the upper permitted power output limit such that the effective HPT based on the upper permitted power output limit is no greater than the HPT of the leading vehicle system 300. Thus, the trailing vehicle system 200 sets the HPT to 0.8 again, and the trailing vehicle system 200 travels between times T7 and T8 with a top permitted throttle setting that is associated with the HPT of 0.8 (e.g., Notch 3). Thus, the trailing vehicle system 200 may travel within the pacing range 320 of the leading vehicle system 300 by adjusting the power output of the leading vehicle system 300 based on the relative location of the trailing vehicle system 200 to the near and far proximity thresholds 308, 316.

Figure 5:
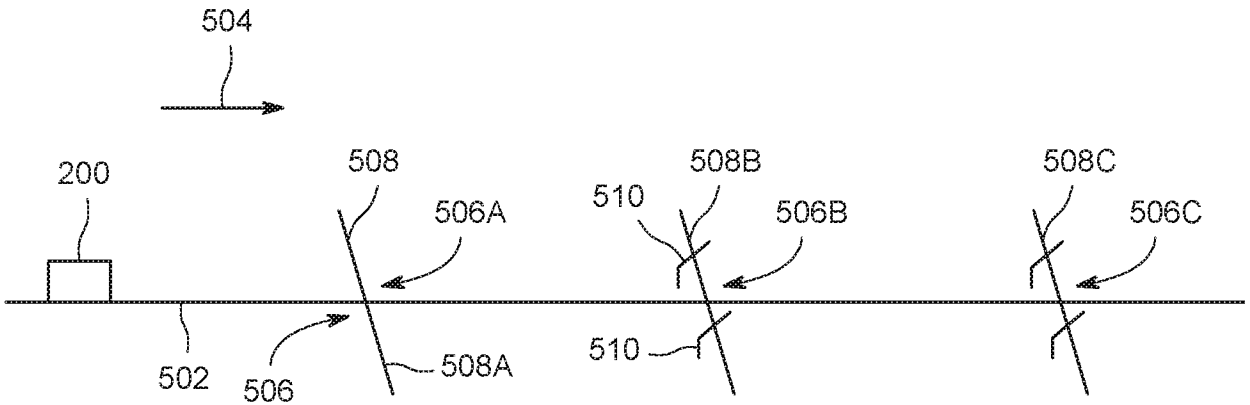
FIG. 5 is a schematic diagram of a vehicle system traveling along a route that includes multiple crossings according to an embodiment.

FIG. 5 is a schematic diagram of a vehicle system 200 traveling along a route 502 that includes multiple crossings 506 according to an embodiment. The vehicle system 200 may be the vehicle system 200 shown in FIG. 2. The vehicle system 200 travels along the route 502 in a direction 504 towards the crossings 506. Each crossing 506 corresponds to intersection of the first route 502 with an intersecting route 508. The first route 502, for example, may be configured as a railroad track over which a rail vehicle may travel. The intersecting route 508 at each crossing 506 may be a road or highway that is paved, leveled, or otherwise configured for automobile and/or truck travel. The crossings 506 may be considered as grade crossings in which the intersecting route 508 is at the grade of the first route 502.

The trip planning controller 206 (shown in FIG. 2) of the vehicle system 200 is configured to provide an automatic audible warning as the vehicle system 200 approaches one or more of the crossings 506. Thus, the trip planning controller 206 controls the operation of the audible warning without the need for operator input. Although operator input may not be required, the vehicle system 200 may not override the ability of the operator to actuate the audible warning, which may be accomplished via the manual input device 210 (shown in FIG. 2). Thus, the trip planning controller 206 may actuate the audible warning unless the operator manually actuates the audible warning in the same time period.

In an embodiment, the locations of the crossings 506 along the route 502 are able to be retrieved and/or received by the trip planning controller 206. For example, the locations may be retrieved from a database in the memory 226 (shown in FIG. 2) of the trip planning controller 206 in which the location information is stored. The crossings 506 may be mapped in order to provide the geographical coordinates of each crossing 506. As an alternative to retrieving the location information from a database, the information may be received from a remote source, such as from a wayside device that the vehicle system 200 passes along the route 502, another vehicle system, or a dispatch location. The location information may be transmitted in a message format from the remote source to the vehicle system 200.

In addition to the location information, additional information associated with each crossing 506 may also be stored in the memory 226 or received from a remote source. The additional information may include whether the corresponding crossing 506 is private or public, whether the crossing 506 is marked or unmarked, and whether there are any restrictions or rules associated with the crossing 506. A private crossing is privately owned, such as a dirt road on a farm that crosses the route 502. A public crossing is publicly owned, such as a public paved street or highway. Marked crossings include signs, indicator lights, crossing gates, and/or the like, to warn people and animals when a vehicle system is approaching the crossing, and unmarked crossings may not include such items. For example, private crossings may be unmarked or marked crossings. Public crossings are typically all marked crossings.

The restrictions and/or rules may include noise level restrictions based on time of day, location (e.g., work zones, quiet zones), and/or the like. For example, a specific crossing may be located in a quiet zone in which vehicles traveling along the route 502 are instructed not to actuate an audible warning as the vehicle approaches the crossing during night hours, such as between 10 P.M. and 6 A.M. In another example, the vehicle may be allowed to actuate an audible warning as the vehicle approaches the specific crossing at a given time of day, but the noise level of the audible warning is restricted to be less than a designated threshold noise level, such as 100 decibels (dB), 80 dB, 50 dB, or the like. Optionally, the restrictions and/or rules may include speed restrictions and/or emissions restrictions through the crossings in addition to noise restrictions. Therefore, as the vehicle system 200 travels along the route 502, the locations of and identifying information about each crossing 506 may be known and stored in a database of the vehicle system 200. Optionally, the vehicle system 200 may be configured to receive updated information about the crossings 506 as the vehicle system 200 moves along the route 502, such as by the communication circuit 212 receiving status messages that update noise level restrictions for one or more of the upcoming crossings 506. The update information can come from a centralized source (e.g., a dispatch center) or from devices installed at or near the crossings.

As the vehicle system 200 travels towards the crossings 506, the trip planning controller 206 monitors the current location of the vehicle system 200 relative to the crossings 506 and the current time of day. The trip planning controller 306 monitors the current location of the vehicle system 200 via the locator device 216 (shown in FIG. 2), and monitors the current time of day via the clock 228 (FIG. 2). The controller 206 (using the one or more processors 224 thereof) is able to determine the proximity of the vehicle system 200 to each of the crossings 506 as the vehicle system 200 moves along the route 502 based on the stored locations of the crossings 506 and the monitored location of the vehicle system 200. The controller 306 further monitors the speed of the vehicle system 200 via the speed sensor 218 (shown in FIG. 2).

As shown in FIG. 5, the vehicle system 200 first approaches a first crossing 506A. The intersecting route 508 at the first crossing 506A is a first intersecting route 508A. The first crossing 506A in the illustrated embodiment is a private crossing, and the route 508A may be a private dirt, stone, or paved road. In an embodiment, the trip planning controller 206 uses the stored database to identify the upcoming crossing 506A as a private crossing that does not require an audible warning. For example, since the intersecting route 508A has very little traffic, there is little risk of a person being present on the route 508A as the vehicle system 200 traverses through the crossing 506A. Thus, the trip planning controller 206 does not actuate the audible warning emitter 214 (shown in FIG. 2) as the vehicle system 200 traverses the first crossing 506A.

As the vehicle system 200 travels between the first crossing 506A and a second crossing 506B along the route 502, the trip planning controller 206 identifies the upcoming second crossing 506B in the database that is stored in the memory 226 based on the location of the vehicle system 200 relative to the stored location of the second crossing 506B. Upon identifying the crossing 506B, the trip planning controller 206 consults the database to determine the type of crossing and whether any noise restrictions are present, and also determines the proximity of the vehicle system 200 to the crossing 506B. In the illustrated embodiment, the second crossing 506B is a public crossing that includes markings, such as crossing gates 510. Although such a public crossing would typically necessitate an audible warning, the second crossing is associated with a time-of-day noise restriction that prohibits the sounding of any warning between the hours of 9 P.M. and 7 A.M. each day. The trip planning controller 206 determines, via the clock 228, that the current time is 4 A.M. and so the vehicle system 200 will travel through the crossing 506B within the restricted time period. Therefore, the controller 206 determines that the audible warning emitter will not be actuated as the vehicle system 200 approaches and passes through the second crossing 506B.

The vehicle system 200 next approaches a third crossing 506C after traversing the second crossing 506B. Based on the information stored in the database on the vehicle system 200 and the determined current location of the vehicle system 200, the trip planning controller 206 identifies the third crossing 506C as a public, marked crossing. The third crossing 506C is near residential housing, for example, and there is a noise restriction associated with the third crossing 506C that limits the noise level of audible warnings to be no greater than 100 dB. Therefore, the trip planning controller 206 may prepare to actuate the audible emitter 214 at a level that produces a warning no greater than 100 dB. The controller 206 continues to monitor the proximity of the vehicle system 200 to the third crossing 506C and the speed of the vehicle system 200 as the vehicle system 200 approaches the crossing 506C. The controller 206 determines when to actuate the emitter 214 based on the speed and proximity to the crossing 506C. For example, a regulation may direct the audible warning to consist of a sequence of two long pulses, one short pulse, and one long pulse at the end, such that the long pulse occurs as the front of the vehicle system 200 passes through the corresponding crossing. The entire sequence may take a given time period, such as 15 seconds. Therefore, based on the speed of the vehicle system and the known time period for the sequence of warning sounds, the trip planning controller 206 determines the distance from the crossing 506C at which to initiate the sequence of warning sounds. For example, if the vehicle system 200 travels at a constant speed of 60 mph and the time period for the sequence of warning sounds is 15 sec, then the trip planning controller 206 determines that the sequence should be initiated when the front of the vehicle system 200 is 0.25 miles from the crossing 506C (e.g., distance=speed*time). The trip planning controller 206 continues to monitor the location of the vehicle system 200 relative to the crossing 506C, and actuates the audible warning emitter 214 to generate the warning sequence (at a noise level of less than 100 dB) responsive to the front of the vehicle system 200 crossing the quarter mile proximity threshold.

One or more technical effects of the automatic warning system described above is a reduced operational load on the operator of the vehicle system and more consistent and accurate warning activations due to reduced human involvement.

In one or more embodiments, the display device 208 (shown in FIG. 2) of the vehicle system 200 is configured to automatically display information to an operator of the vehicle system 200 regarding upcoming route aspects, such as crossings, signals, and the like. For example, as the vehicle system 200 approaches a crossing (e.g., one of the crossings 506 shown in FIG. 5), the trip planning controller 206 may be configured to display on the display device 208 a countdown in terms of distance and/or time until the vehicle system 200 reaches the crossing. For example, the countdown may be displayed adjacent to an icon or symbol for a crossing as a successive series of distances, such as 1 mi ahead, 0.5 mi ahead, 0.25 mi ahead, and the like. The countdown is determined based on the known location of the crossing, the speed of the vehicle system 200, and the location of the vehicle system 200. The trip planning controller 206 may also display information about the crossing, such as whether the controller 206 will actuate the audible warning emitter 214 (shown in FIG. 2) for this crossing. For example, the controller 206 may display an indicator to an operator that identifies the upcoming crossing as being associated with a quiet order that restricts audible warnings. The display device 208 may provide a text-based signal that states, for example, "Quiet zone; Horn not activated." Thus, the operator viewing the display device 208 is notified that the audible warning emitter 214 should not be actuated upon approaching the upcoming crossing.

In an embodiment, the display device 208 of the vehicle system 200 may also be configured to display information about wayside signal aspects, such as crossing signals, block signals, and the like. The trip planning controller 206 may be configured to display both proximity information, such as a countdown in terms of distance and/or time, of an upcoming signal aspect as well as additional information identifying and describing the signal aspect. For example, an upcoming signal aspect may be a block signal that provides an indicator of whether another vehicle is ahead along the route in one of the next few blocks, such as one of the next two blocks. The route may be electrically segmented to form multiple blocks arranged side-by-side along a length of the route. If a vehicle system is approaching a block in which another vehicle is currently occupying, a block signal may be configured to notify the approaching vehicle system to slow to a stop in order to avoid an accident. Similarly, if the vehicle system approaches a first block and another vehicle is currently occupying a second block next to and beyond the first block, the block signal may notify the approaching vehicle system to slow to a designated lower speed and/or to be prepared to stop. Some block signals may provide an "all clear" signal if the upcoming few blocks are unoccupied, a "stop" signal if the upcoming block is occupied, and an "approach" signal if the first upcoming block is unoccupied but the second upcoming block is occupied. Optionally, the "all clear" signal aspect may be represented by a green over red indication on the block signal, the "stop" signal may be represented by two red lights, and the "approach" signal may be represented by a yellow over red indication.

In an embodiment, the trip planning controller 206 is configured to store location information and identification information about the signal aspects in a database within the memory 224. The identification information may include a type of signal (e.g., crossing signal or block signal), a part number of the signal, a physical layout of the signal, and the like. For example, the trip planning controller 206 may store a graphical image that corresponds to the actual signal device. Thus, as the vehicle system 200 approaches the signal aspect, the trip planning controller 206 identifies the upcoming signal and displays the graphical image on the display device 208. Furthermore, the trip planning controller 206 receives a status of the signal, such as whether a given block signal is providing an "all clear" signal, an "approach" signal, or a "stop" signal aspect. The trip planning controller 206 receives the status of the signal via a message from a wayside device (e.g., the signaling device), a dispatch location, another vehicle, an aerial device ahead of the vehicle system 200, or the like. The trip planning controller 206 is configured to receive the status of the signal before the status is within eyesight of the operator, due to the distance or obstacles between the signal and the vehicle system 200. In an embodiment, upon receiving the status of the signal device, the trip planning controller 206 is configured to display the status on the display device 208 as an indicator for viewing by the operator. The indicator may be presented on the graphical image of the signal device. For example, if the status is an "all clear" signal, the controller 206 may display a green light in an appropriate location on the graphical image of the signal device. Optionally, if the status is an "approach" signal or a "stop" signal aspect, the trip planning controller 206 may take further actions in addition to displaying the corresponding graphics on the display device 208. For example, the trip planning controller 206 may also actuate an audible, visual, and/or tactile (e.g., vibrating) alert for the operator. The trip planning controller 206 optionally may automatically slow the vehicle system 200 or at least instruct the operator to manually slow the vehicle system 200. The trip planning controller 206 also may automatically send a message to an off-board location, such as to a dispatch location or to one or more surrounding vehicles. One or more technical effects of the display system described above is to allow the operator to have advanced knowledge of the information prior to the vehicle system traveling within eyesight distance of a route aspect, such as a block signal or a crossing signal.

In an embodiment, the trip planning controller 206 is configured to update a generated trip plan during a trip of the vehicle system 200 along a route based on an order received via a positive train control (PTC) network. The PTC network may provide location-based orders for vehicles traveling through designated locations. The orders may be based on a rule or requirement of operation for a particular route segment, such as a speed limit or the like. The orders received via the PTC network may override or interrupt a previously planned controlled activity (e.g., a control activity previously determined by the trip planning controller 206) and/or an operator controlled activity. For example, upon receiving a slow order from the PTC network, the vehicle system 200 may be controlled to automatically slow to a designated speed posted in the slow order. The automatic braking may be controlled by the trip planning controller 206 and/or the vehicle controller 202 (shown in FIG. 2). The communication circuit 212 may be configured to receive the PTC orders. In an embodiment, information from an order received via the PTC network may be displayed on the display device to the operator of the vehicle system 200. The information may include the designated speed limit for a designated segment of the route. The operator may use the manual input device 210 to confirm the slow order. The trip planning controller 206 may be configured to generate an updated trip plan that incorporates the PTC order. For example, the trip planning controller 206 may re-plan the segment of the trip associated with the slow order, and may incorporate the designated speed limit of the slow order as a constraint in the analysis.

In another embodiment, the trip planning controller 206 is configured to automatically control movement of the vehicle system 200 through a work zone (e.g., a maintenance of way (MOW) zone) based on operator-input. For example, as the vehicle system 200 approaches a work zone in which a crew may be actively working on the route, the operator and/or the trip planning controller 206 may receive a communication from the crew, such as from a foreman of the crew. The communication expresses how the vehicle system 200 should travel through the work zone for the safety of the crew. For example, the communication may indicate that the vehicle system 200 is allowed to travel through the work zone at full speed, at a designated lower speed, or is required to stop before entering the work zone. In one embodiment, the operator may receive the communication, such as through a phone, a handheld transceiver, or the like, and may convey the message to the trip planning controller 206 via the manual input device 210. Alternatively, the trip planning controller 206 receives the communication from the crew, such as via the communication circuit 212, and displays the information to the operator on the display device 208. The operator is then able to confirm and/or select a movement plan for the upcoming work zone using the manual input device 210. In response to receiving an operator selection, the trip planning device 206 is configured to modify the trip plan to incorporate the selection. For example, in response to receiving an operator selection of traveling through the work zone at no more than 20 mph, the trip planning controller 206 may re-plan the segment of the trip associated with the work zone, and may incorporate the designated speed limit of 20 mph as a constraint in the re-planning analysis. Thus, the trip planning controller 206 may continue to control the movement of the vehicle system 200 as the vehicle system 200 traverses through the work zone.

Figure 6:
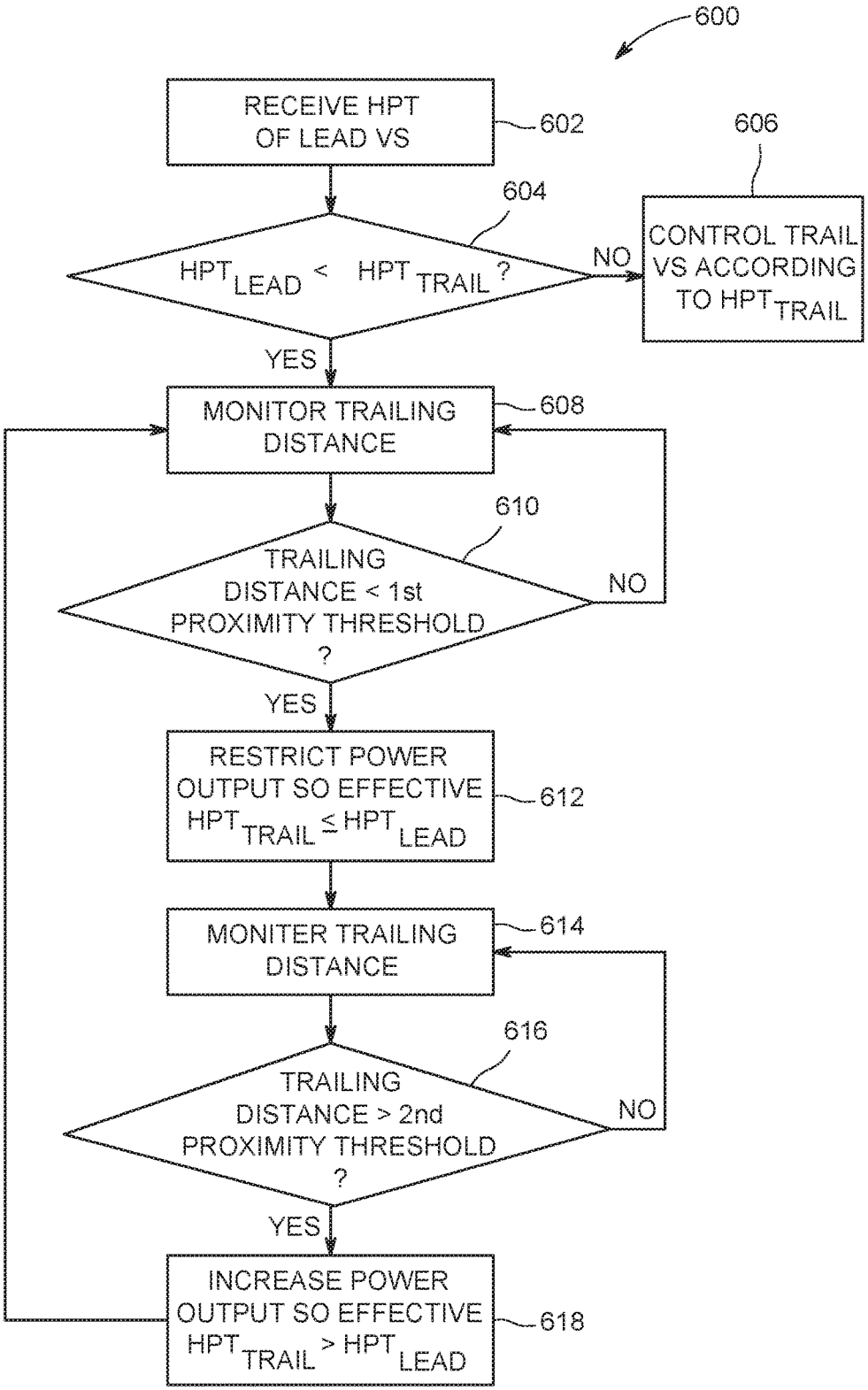
FIG. 6 is a flow chart of a method for controlling a vehicle system relative to another vehicle system ahead that is traveling along the same route in the same direction.

FIG. 6 is a flow chart of a method 600 for controlling a vehicle system relative to a vehicle system ahead traveling along the same route in the same direction. The vehicle system may be the vehicle system 200 shown in FIG. 2 and FIG. 3. The method 600 is configured to pace the movement of the vehicle system, referred to as a trailing vehicle system, based on the movement of a leading vehicle system ahead of the trailing vehicle system on the same route. The method 600 is configured to avoid the trailing vehicle system traveling too closely to the leading vehicle system, requiring the trailing vehicle system to stop and/or slow to considerably low speed for safety reasons. At 602, the trailing vehicle system receives a power-to-weight ratio of the leading vehicle system. The power-to-weight ratio represents the available power output of a vehicle system (to be used for propelling the vehicle system along the route) divided by the weight or mass of the vehicle system. In an embodiment, the power-to-weight ratio is represented as HPT, which stands for horsepower per tonnage. The HPT of the leading vehicle system may be received as a message communicated wirelessly, may be stored in a database onboard the trailing vehicle system, or the like. After the HPT of the leading vehicle system is received, the HPT of the leading vehicle system (shown in FIG. 6 as $HPT_{Lead}$) is compared to the HPT of the trailing vehicle system (shown in FIG. 6 as $HPT_{Trail}$).

At 604, a determination is made as to whether the HPT of the leading vehicle system is less than the HPT of the trailing vehicle system. If not, such that the HPT of the leading vehicle is equal to or greater than the HPT of the trailing vehicle, then flow of the method 600 proceeds to 606, and the trailing vehicle system is controlled along the route according to the HPT of the trailing vehicle system. Therefore, the trailing vehicle system is not controlled based on the leading vehicle system. If, on the other hand, the HPT of the leading vehicle is indeed less than the HPT of the trailing vehicle system, then flow proceeds to 608. At 608, a trailing distance between the leading vehicle system and the trailing vehicle system is monitored. The trailing distance may be monitored using a locator device on the trailing vehicle system to determine updated location information for the trailing vehicle system and a communication circuit that receives messages regarding the updated location of the leading vehicle system. Alternatively, the trailing distance may be monitored by consulting a trip plan being implemented by the leading vehicle system. For example, the trailing vehicle system may analyze the trip plan according to which the leading vehicle system is being controlled to determine an expected location of the leading vehicle system at a respective time. The trip plan implemented by the leading vehicle system optionally may be generated by the trailing vehicle system and communicated to the leading vehicle system.

At 610, a determination is made as to whether the trailing distance is less than a first proximity distance relative to the leading vehicle system. Thus, if the trailing vehicle system is closer to the leading vehicle system than a first proximity threshold that demarcates a distal end of the first proximity distance, then the determination is in the affirmative and flow of the method 600 proceeds to 612. But, if the trailing vehicle system is not closer to the leading vehicle system than the first proximity threshold, then the determination is negative and flow returns to 608 for continued monitoring of the trailing distance.

At 612, the power output of the trailing vehicle system is restricted or limited such that an effective HPT of the trailing vehicle system is less than or equal to the HPT of the leading vehicle system. For example, the trailing vehicle system may limit the power output by restricting the throttle settings. Instead of using notch levels 1 through 8, the throttle settings may be limited such that only notch levels 1 through 5 are used. At the lower throttle settings, the power generated for propelling the vehicle system provides an effective power-to-weight ratio that is no greater than the available power-to-weight ratio of the leading vehicle system. At 614, the trailing distance between the leading and trailing vehicle systems is monitored, like at 608. At 616, a determination is made whether the trailing distance is greater than a second proximity distance. The second proximity distance is measured from the leading vehicle system and extends to a second proximity threshold at a distal end of the second proximity distance. The second proximity threshold is farther from the leading vehicle system than the first proximity threshold. If the trailing distance is greater than the second proximity distance, then at least a portion of the trailing vehicle system is farther from the leading vehicle system than the second proximity threshold, and flow continues to 618. If, on the other hand, the trailing distance is not greater than the second proximity distance, then the determination is negative and flow of the method 600 returns to 614 for continued monitoring of the trailing distance.

At 618, the power output of the trailing vehicle system is increased such that the effective HPT of the trailing vehicle system is greater than the HPT of the leading vehicle system. Therefore, instead of being restricted to using throttle settings of notch levels 1-5, the effective HPT is increased by allowing the use of notch level 6, notch levels 6 and 7, or all of the notch levels 6, 7, and 8. The throttle settings are used by the trip planning controller according to a trip plan in order to control the movement of the trailing vehicle system along the route. After 618, flow returns to 608 for continued monitoring of the trailing distance.

In an embodiment, a system (e.g., a vehicle control system) includes a locator device, a communication circuit, and one or more processors. The locator device is disposed onboard a trailing vehicle system that is configured to travel along a route behind a leading vehicle system that travels along the route in a same direction of travel as the trailing vehicle system. The locator device is configured to determine a location of the trailing vehicle system along the route. The communication circuit is disposed onboard the trailing vehicle system. The communication circuit is configured to periodically receive a status message that includes a location of the leading vehicle system. The one or more processors are onboard the vehicle system and are operably connected to the locator device and the communication circuit. The one or more processors are configured to verify that a power-to-weight ratio of the leading vehicle system is less than a power-to-weight ratio of the trailing vehicle system. The power-to-weight ratios of the leading vehicle system and the trailing vehicle system are based on respective upper power output limits of the leading and trailing vehicle systems. The one or more processors are further configured to monitor a trailing distance between the trailing vehicle system and the leading vehicle system based on the respective locations of the leading and trailing vehicle systems. Responsive to the trailing distance being less than a first proximity distance relative to the leading vehicle system, the one or more processors are configured to set an upper permitted power output limit for the trailing vehicle system that is less than the upper power output limit of the trailing vehicle system to reduce an effective power-to-weight ratio of the trailing vehicle system.

Optionally, the one or more processors set the upper permitted power output limit for the trailing vehicle system such that the effective power-to-weight ratio of the trailing vehicle system based on the upper permitted power output limit is no greater than the power-to-weight ratio of the leading vehicle system.

Optionally, the trailing vehicle system includes at least one propulsion system that provides tractive effort to move the trailing vehicle system along the route. The power-to-weight ratio of the trailing vehicle system represents a total available tractive effort that can be provided by the at least one propulsion system divided by a total weight of the trailing vehicle system.

Optionally, the communication circuit is configured to receive the status message that includes the location of the leading vehicle system from at least one of the leading vehicle system, a dispatch location, or an aerial device.

Optionally, responsive to the trailing distance being less than a first proximity distance, the one or more processors set the upper permitted power output limit for the trailing vehicle system by restricting throttle settings used to control propulsion of the trailing vehicle system to exclude at least a top throttle setting that is associated with the upper power output limit of the trailing vehicle system.

Optionally, the one or more processors control the movement of the trailing vehicle system along an upcoming section of the route according to the upper permitted power output limit such that a power output of the trailing vehicle system for propelling the trailing vehicle system along the route does not exceed the upper permitted power output limit.

Optionally, the one or more processors are configured to continue monitoring the trailing distance subsequent to setting the upper permitted power output limit of the trailing vehicle system. Responsive to the trailing distance being greater than a second proximity distance relative to the leading vehicle system, the one or more processors are configured to increase the upper permitted power output limit of the trailing vehicle system such that the effective power-to-weight ratio of the trailing vehicle system that results is greater than the power-to-weight ratio of the leading vehicle system. The second proximity distance extends farther from the leading vehicle system than the first proximity distance. Optionally, the one or more processors increase the upper permitted power output limit to an adjusted upper permitted power output limit that is at least one of equal to or less than the upper power output limit of the trailing vehicle system.

Optionally, the first proximity distance extends rearward from the leading vehicle system to a first proximity threshold. The one or more processors determine that the trailing distance is less than the first proximity distance responsive to a designated portion of the trailing vehicle system being more proximate to the leading vehicle system than a proximity of the first proximity threshold to the leading vehicle system.

Optionally, the one or more processors of the trailing vehicle system determine the power-to-weight ratio of the leading vehicle system by at least one of retrieving the power-to-weight ratio of the leading vehicle system from storage in a memory onboard the trailing vehicle system or by the communication circuit receiving the power-to-weight ratio in a message from at least one of the leading vehicle system or a dispatch location.

Optionally, the one or more processors of the trailing vehicle system determine the power-to-weight ratio of the trailing vehicle system by at least one of retrieving the power-to-weight ratio of the leading vehicle system from storage in a memory onboard the trailing vehicle system or by the communication circuit receiving the power-to-weight ratio in a message from a dispatch location.

In another embodiment, a method (e.g., for controlling movement of a trailing vehicle system) includes determining a power-to-weight ratio of a leading vehicle system that is on a route and disposed ahead of a trailing vehicle system on the route in a direction of travel of the trailing vehicle system. The method includes verifying that the power-to-weight ratio of the leading vehicle system is less than a power-to-weight ratio of the trailing vehicle system. The power-to-weight ratios of the leading vehicle system and the trailing vehicle system are based on respective upper power output limits of the leading and trailing vehicle systems. The method also includes monitoring a trailing distance between the trailing vehicle system and the leading vehicle system along the route. The method further includes, responsive to the trailing distance being less than a first proximity distance relative to the leading vehicle system, setting an upper permitted power output limit that is less than the upper power output limit. An effective power-to-weight ratio of the trailing vehicle system based on the upper permitted power output limit is no greater than the power-to-weight ratio of the leading vehicle system.

Optionally, the method further includes controlling the movement of the trailing vehicle system along an upcoming section of the route according to the upper permitted power output limit. The movement is controlled according to the upper permitted power output limit such that a power output of the trailing vehicle system for propelling the trailing vehicle system along the route does not exceed the upper permitted power output limit.

Optionally, the power-to-weight ratio of the leading vehicle system is received onboard the trailing vehicle system in a message that is received by a communication circuit of the trailing vehicle system.

Optionally, the trailing distance is monitored by periodically receiving a status message that includes an updated location of the leading vehicle system and comparing the updated location of the leading vehicle system to a current location of the trailing vehicle system determined via a locator device onboard the trailing vehicle system.

Optionally, responsive to the trailing distance being less than a first proximity distance, the upper permitted power output limit of the trailing vehicle system is set by restricting throttle settings used to control propulsion of the trailing vehicle system to exclude at least a top throttle setting that is associated with the upper power output limit of the trailing vehicle system.

Optionally, the method further includes monitoring the trailing distance subsequent to setting the upper permitted power output limit of the trailing vehicle system. Responsive to the trailing distance being greater than a second proximity distance relative to the leading vehicle system, the method includes increasing the upper permitted power output limit of the trailing vehicle system such that the effective power-to-weight ratio of the trailing vehicle system that results is greater than the power-to-weight ratio of the leading vehicle system. The second proximity distance extends farther from the leading vehicle system than the first proximity distance. Optionally, the upper permitted power output limit is increased to an adjusted upper permitted power output limit that is at least one of equal to or less than the upper power output limit of the trailing vehicle system.

Optionally, the first proximity distance extends rearward from the leading vehicle system to a first proximity threshold. The trailing distance is determined to be less than the first proximity distance responsive to a designated portion of the trailing vehicle system being disposed between the first proximity threshold and the leading vehicle system.

Optionally, the first proximity distance is greater than a sum of at least a safe braking distance for the trailing vehicle system and a response time distance for the trailing vehicle system.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose several embodiments of the inventive subject matter, and also to enable one of ordinary skill in the art to practice the embodiments of inventive subject matter, including making and using any devices or systems and performing any incorporated methods. The patentable scope of the inventive subject matter is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

The foregoing description of certain embodiments of the present inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, controllers or memories) may be implemented in a single piece of hardware (for example, a general purpose signal processor, microcontroller, random access memory, hard disk, and the like). Similarly, the programs may be stand-alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" or "an embodiment" of the presently described inventive subject matter are not intended to be interpreted as excluding the existence of additional embodiments that also incorporate the recited features. Moreover, unless explicitly stated to the contrary, embodiments "comprising," "comprises," "including," "includes," "having," or "has" an element or a plurality of elements having a particular property may include additional such elements not having that property.

As used herein, the terms "system," "device," or "unit" may include a hardware and/or software system that operates to perform one or more functions. For example, a unit, device, or system may include a computer processor, controller, or other logic-based device that performs operations based on instructions stored on a tangible and non-transitory computer readable storage medium, such as a computer memory. Alternatively, a unit, device, or system may include a hard-wired device that performs operations based on hard-wired logic of the device. The units, devices, or systems shown in the attached figures may represent the hardware that operates based on software or hardwired instructions, the software that directs hardware to perform the operations, or a combination thereof. The systems, devices, or units can include or represent hardware circuits or circuitry that include and/or are connected with one or more processors, such as one or computer microprocessors.

What is claimed is:

1. A system comprising:

a locator device configured to determine a trailing distance between a trailing vehicle system that travels along a route and a leading vehicle system that travels along the route ahead of the trailing vehicle system in a same direction of travel; and one or more processors operably connected to the locator device, the one or more processors configured to compare the trailing distance to a first proximity distance relative to the leading vehicle system and, in response to the trailing distance being less than the first proximity distance, set a permitted power output limit for the trailing vehicle system to be less than a maximum achievable power output of the trailing vehicle system, the permitted power output limit being set based on a power-to-weight ratio of the leading vehicle system.

2. The system of claim 1, wherein the one or more processors set the permitted power output limit for the trailing vehicle system such that an effective power-to-weight ratio of the trailing vehicle system is no greater than the power-to-weight ratio of the leading vehicle system.

3. The system of claim 1, further comprising a vehicle controller operably connected to the one or more processors, the vehicle controller configured to control movement of the trailing vehicle system according to the permitted power output limit such that a power output of the trailing vehicle system for propelling the trailing vehicle system along the route does not exceed the permitted power output limit.

4. The system of claim 3, wherein the vehicle controller controls movement of the trailing vehicle system by restricting throttle settings used to control propulsion of the trailing vehicle system to exclude at least a top throttle setting that is associated with the maximum achievable power output of the trailing vehicle system.

5. The system of claim 1, wherein the one or more processors are configured to monitor the trailing distance subsequent to setting the permitted power output limit for the trailing vehicle system, and, in response to the trailing distance being greater than a second proximity distance that extends farther from the leading vehicle system than the first proximity distance relative to the leading vehicle system, increase the permitted power output limit for the trailing vehicle system to an adjusted permitted power output limit that is no greater than the maximum achievable power output of the trailing vehicle system.

6. The system of claim 5, wherein the adjusted permitted power output limit is set such that an effective power-to-weight ratio of the trailing vehicle system is greater than or equal to the power-to-weight ratio of the leading vehicle system.

7. The system of claim 1, further comprising a communication circuit operably connected to the one or more processors, the communication circuit configured to receive, from at least one of the leading vehicle system or a dispatch system, a message that includes the power-to-weight ratio of the leading vehicle system.

8. The system of claim 1, further comprising a communication circuit operably connected to the one or more processors, the communication circuit configured to receive, from at least one of the leading vehicle system, a dispatch system, or an aerial device, a message that includes a location of the leading vehicle system, wherein the locator device determines the trailing distance based on the message.

9. The system of claim 1, wherein the first proximity distance is adjusted based on at least one of a speed of the trailing vehicle system or a speed of the leading vehicle system.

10. A method comprising:

determining a trailing distance between a trailing vehicle system that travels along a route and a leading vehicle system that travels along the route ahead of the trailing vehicle system in a same direction of travel;

comparing the trailing distance to a first proximity distance relative to the leading vehicle system; and in response to the trailing distance being less than the first proximity distance, setting a permitted power output limit for the trailing vehicle system to be less than a maximum achievable power output of the trailing vehicle system, the permitted power output limit being set based on a power-to-weight ratio of the leading vehicle system.

11. The method of claim 10, wherein the permitted power output limit for the trailing vehicle system is set such that an effective power-to-weight ratio of the trailing vehicle system is no greater than the power-to-weight ratio of the leading vehicle system.

12. The method of claim 10, further comprising controlling movement of the trailing vehicle system according to the permitted power output limit such that a power output of the trailing vehicle system for propelling the trailing vehicle system along the route does not exceed the permitted power output limit.

13. The method of claim 12, wherein controlling movement of the trailing vehicle system comprises restricting throttle settings used to control propulsion of the trailing vehicle system to exclude at least a top throttle setting that is associated with the maximum achievable power output of the trailing vehicle system.

14. The method of claim 10, further comprising monitoring the trailing distance subsequent to setting the permitted power output limit for the trailing vehicle system, and, in response to the trailing distance being greater than a second proximity distance that extends farther from the leading vehicle system than the first proximity distance relative to the leading vehicle system, increasing the permitted power output limit for the trailing vehicle system to an adjusted permitted power output limit that is no greater than the maximum achievable power output of the trailing vehicle system.

15. The method of claim 14, wherein the adjusted permitted power output limit is set such that an effective power-to-weight ratio of the trailing vehicle system is greater than or equal to the power-to-weight ratio of the leading vehicle system.

16. The method of claim 10, further comprising receiving, from at least one of the leading vehicle system or a dispatch system, a message that includes the power-to-weight ratio of the leading vehicle system.

17. The method of claim 10, further comprising receiving, from at least one of the leading vehicle system, a dispatch system, or an aerial device, a message that includes a location of the leading vehicle system, wherein the trailing distance is determined based on the message.

18. The method of claim 10, further comprising adjusting the first proximity distance based on at least one of a speed of the trailing vehicle system or a speed of the leading vehicle system.

19. A method comprising:

monitoring a trailing distance between a trailing vehicle system that travels along a route and a leading vehicle system that travels along the route ahead of the trailing vehicle system in a same direction of travel; and pacing the trailing vehicle system to travel within a pacing distance range relative to the leading vehicle system based on the trailing distance and a power-to-weight ratio of the leading vehicle system.

20. The method of claim 19, wherein pacing the trailing vehicle system comprises setting a permitted power output limit for the trailing vehicle system based on the power-to-weight ratio of the leading vehicle system, and controlling movement of the trailing vehicle system according to the permitted power output limit such that a power output of the trailing vehicle system for propelling the trailing vehicle system along the route does not exceed the permitted power output limit.

* * * * *